US005328400A

United States Patent [19]

Bass

[11] Patent Number: 5,328,400

[45] Date of Patent: Jul. 12, 1994

[54] DOLL WITH WRAP AROUND FASHIONS

[75] Inventor: Sidney Bass, Los Angeles, Calif.

[73] Assignee: Universal Product Innovations, Inc., Carson, Calif.

[21] Appl. No.: 95,143

[22] Filed: Jul. 20, 1993

[51] Int. Cl.[5] ..... A63H 3/00

[52] U.S. Cl. ..... 446/98; 446/246; 446/475; 446/901; 446/268

[58] Field of Search ..... 446/98, 268, 359, 387, 446/901, 246, 474, 475

[56] References Cited

U.S. PATENT DOCUMENTS

| | | | |
|---|---|---|---|
| 1,330,043 | 2/1920 | Cleaver | 446/98 |
| 2,965,981 | 12/1960 | Giovetti | 446/387 X |
| 3,782,027 | 1/1974 | Goldfarb et al. | 446/98 |
| 4,040,206 | 8/1977 | Kimura | 446/359 X |
| 4,729,751 | 3/1988 | Schiavo et al. | 446/268 |
| 4,834,687 | 5/1989 | Elam | 446/901 X |

*Primary Examiner*—Mickey Yu

*Attorney, Agent, or Firm*—Ronald M. Goldman

[57] ABSTRACT

A doll contains a fabric fastener, such as "Velcro", on the backside, simulating a backbone. A turntable holds the doll in upright position with arms uplifted. A consecutive series of garment sections, each depicting a separate article of clothing, is spooled onto a rotatable cylinder, spaced from the turntable, with the front end section of the spooled garment containing a complementary fabric fastener connected to the fabric fastener on the doll's backside. By rotating the doll about its vertical axis an article of clothing is dispensed from the cylinder and is wrapped about the doll's torso to dress the doll. The doll's clothing is effectively changed by rotating the doll further to dispense the next article of clothing and wrap the latter in overlying relationship with the first article of clothing about the doll's torso. This action may be continued for as many different articles of wrap around clothing as is contained on the cylinder.

20 Claims, 1 Drawing Sheet

DOLL WITH WRAP AROUND FASHIONS

FIELD OF THE INVENTION

This invention relates to fashion dolls and doll garments for those dolls and, more particularly, to a novel means and method for applying and changing the dress of a fashion doll, particularly suited for play by children of pre-school age who possess limited manual dexterity.

BACKGROUND

Cutting different dresses from paper sheets and mounting those paper dresses onto two dimensional figures formed from card board material is a known form of play activity for young females that provides hours of amusement. That play activity provides the child with intellectual stimulation and a learning experience, yet is simple and requires only limited dexterity.

In more modern times that play activity has also been practiced with dolls of three dimensional form, the now ever present plastic fashion dolls, which are available with a wardrobe of clothing sized to fit. The child may dress and undress the doll in endless variety; for visiting friends, for playing baseball, as a bride, a doctor in limitless variety. As one appreciates it requires some dexterity of the child to dress a plastic doll. While that activity is generally accomplished by girls of eight years of age and up, who seem to possess sufficient dexterity by that age, for younger girls, that is not usually the case. Though pre-school age girls may generally find it possible to undress the doll, dressing the doll is found more difficult and the child is usually unsuccessful.

Doll makers have long sought to discover a suitable structure to make the doll easier to dress and undress in order to make that play activity available to younger girls. The prospect of a young child's appreciative smile and an expanded market for doll product has long provided more than ample encouragement for the doll manufacturer to reach that achievement. As example of one such attempt, the "My First Barbie" doll employed straight legs so that a child could more easily pull a garment up from the bottom over the dolls torso, avoiding the interference that a bendable doll leg could cause the child. Others have suggested use of an adhesive so that the garment may be simply stuck to the doll's torso. However, a sticky doll torso was found unacceptable for obvious reasons.

The present invention offers a novel solution. It provides the means for a pre-school age child to easily dress the doll.

An object of the present invention is to provide a doll whose outer garment may be easily be changed requiring only the limited dexterity level characteristic of a pre-school aged child to accomplish a perceived change the change of clothes.

An ancillary object of the invention is to provide a novel structure in a doll's clothing garment and a novel doll structure to hold the doll clothing in place for quickly and easily dressing the doll structure and then re-dressing the doll.

SUMMARY OF THE INVENTION

To that purpose the present invention presents a doll that contains a fastener, suitably a fabric fastener such as "Velcro", on the backside, simulating a backbone. A turntable holds the doll in upright position with arms uplifted. A consecutive series of garment sections, each depicting a separate article of clothing, is spooled onto a rotatable cylinder, spaced from the turntable, with the front end section of the spooled garment containing a complementary fabric fastener connected to the fabric fastener on the doll's backside. By rotating the doll about its vertical axis an article of clothing is dispensed from the cylinder and is wrapped about the doll's torso to dress the doll. The doll's clothing is effectively changed by rotating the doll further to dispense the next article of clothing and wrap the latter in overlying relationship with the first article of clothing about the doll's torso.

The foregoing action may be continued for as many different articles of wrap around clothing as is contained on the cylinder. As example the first article may be underwear, the next a blouse and/or a skirt, the next a coat and so on. The child need only turn the turntable to make the change. As an additional feature a hand crank is provided so that rotation of the turn table is easily accomplished by turning the hand crank.

The foregoing and additional objects and advantages of the invention together with the structure characteristic thereof, which was only briefly summarized in the foregoing passages, becomes more apparent to those skilled in the art upon reading the detailed description of a preferred embodiment, which follows in this specification, taken together with the illustration thereof presented in the accompanying drawings.

DETAILED DESCRIPTION OF A PREFERRED EMBODIMENT

Figure 1:
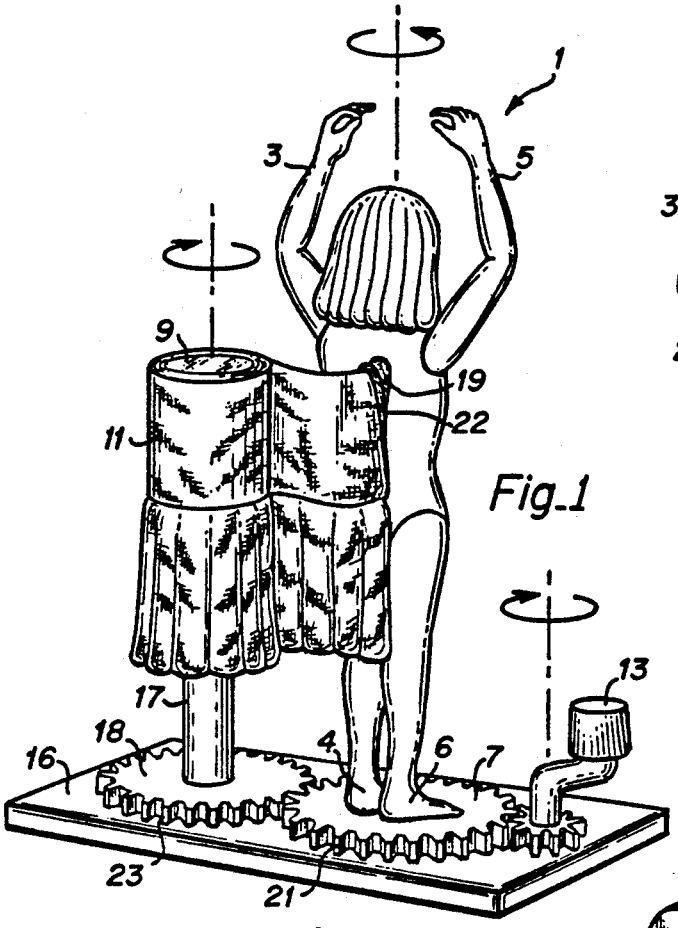
FIG. 1 illustrates a preferred embodiment of the invention in perspective view.

Reference is made to FIG. 1 showing a doll 1, simulating a female figure, with arms 3 and 5 posed in uplifted position. The doll is mounted in upstanding position with its feet 4 and 6 upon a turntable 7 in spaced relationship to a spool or cylinder 9, about which is wound band or swatch of cloth or a wrap around garment, as variously termed, 11. Cylinder 9 is supported by a shaft 17 which in turn is connected to disk 18, for axial rotation on base 16, in spaced relationship to the turntable axis. A hand crank 13 is connected to a gear 15 and the latter is mounted for rotation on base 16.

The turntable contains gear teeth 21, that engage gear teeth 23 on disk 18 and also engage the teeth of gear 15 associated with the hand crank. This allows joint rotational movement therebetween in a driving and driven relationship. In this embodiment all of the gears rotate about an axis that is perpendicular to base 16 and all of the axes of rotation are essentially parallel to one another.

On its back, the doll contains a fabric fastener 19. In order to camouflage the fastener, the fastener, preferably is of the same color as the doll torso, which, typically, is flesh colored. That fabric fastener engages complementary fabric fastener 22 attached to the front end of garment 11. The fabric fastener attached to the doll torso backside is better illustrated in FIGS. 2 and 3 to which reference is made.

Figure 2A:
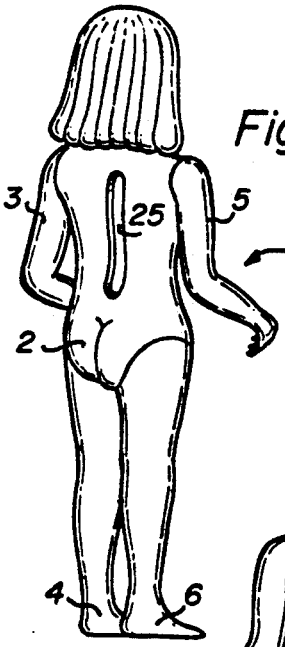
FIG. 2A illustrates the doll structure viewed from the rear and in a preliminary stage of manufacture and FIG. 2B illustrates the same view with the added element of an embedded fastener.

As shown in the partially assembled doll of FIG. 2A, the doll is of a conventional structure containing arms and legs and head and neck connected to a torso 2 all of which are formed of plastic material and are assembled together in a conventional way. The arms and legs are movably mounted in the torso and may be positioned by the user. However the torso contains a slot or recess 25. The recess is narrow and extends vertically along the dolls spine on the backside of the torso.

Figure 2B:
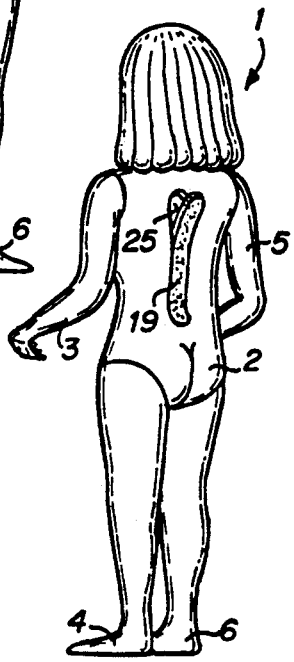

As shown in FIG. 2B a long narrow thin fabric fastener 19, suitably "Velcro" is embedded in the recess to define a backbone or spine in the doll figure. The fabric fastener may be adhered by a suitable non-toxic adhesive or be welded into that position.

The "Velcro" fabric fastener, often referred to simply as Velcro, is believed to be the only known fabric device described as a fastener. It is well known and in wide spread use, including use as a fastener for clothing. Briefly, such fastener consists of a piece of material on which fibers are formed into small hooks and a complementary piece of material in which fibers are formed into loops. When pressed together the hooks on one and loops on the other engage and effectively stick together frictionally to form a strong, yet releasible, connection. The fastener is opened by pulling the two pieces apart with a stronger force than the frictional force holding them together. The fastener may be used repeatedly. Typically the fastener backing material is sewn into garments or is adhesively attached to the elements to be fastened.

Figure 3:
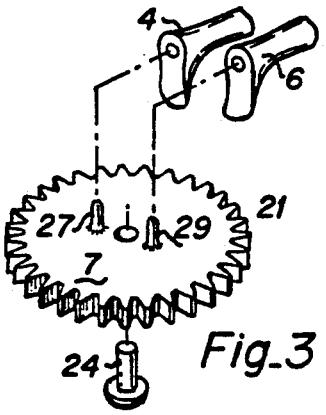
FIG. 3 illustrates the means to position the doll upright on the turntable in FIG. 1.

Referring now to FIG. 3, the doll is mounted to the turntable 7 by a pair of upstanding pins or prongs 27 and 29, integrally molded in the turntable, evenly spaced about the rotational axis of the turntable. The pins fit into small holes, not numbered, located in the bottom of the doll's feet, 4 and 6, so that rotation of the turntable rotates the doll about the doll's vertical axis. It is noted that turntable may be mounted to base 16 by a rivet type shaft 24 or any other conventional means.

Figure 4:
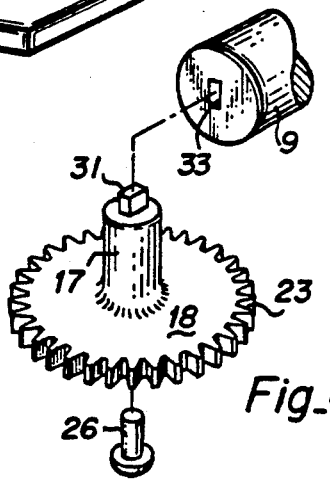
FIG. 4 shows further details of the spool member used in the embodiment of FIG. 1.

Referring next to FIG. 4, shaft 17 is coupled to cylinder 9 by a key member 31, which fits into a key hole 33, in the cylinder, shown partial in partial section and partially removed in this figure, so that rotation of the shaft rotates cylinder 9 about its axis. It may be noted that disk 23 and integral shaft 17 may be mounted to the base by any conventional means that allows rotation, such as shaft rivet 26. Suitably, the gears, base, shafts, crank, spools and turntables may be formed of conventional plastic material.

Figure 5:
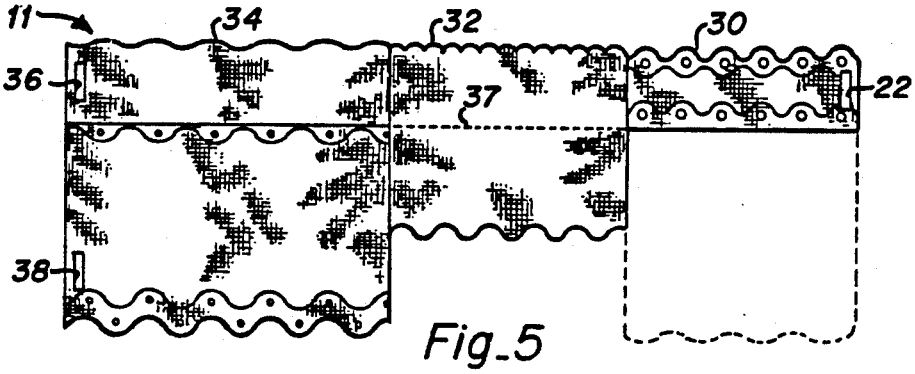
FIG. 5 is a layout illustrating a multi-section wrap around garment useful in the embodiment of FIG. 1.

As illustrated in plan view in FIG. 5 the garment spooled upon cylinder 9 is divided into different sections, 30, 32 and 34, which are distinctively decorated to be different from one another, depicting different pieces of apparel. As example, the first section 30 may be underwear, which is of a short height as shown, or which may be of greater length as represented by the dotted outline. The next section 32 may be a pink colored slip. The third section 34 may be a blouse and skirt. The sections may be separately made and sewn together or, alternatively, created by printing different patterns and colors on a single length of fabric material. In those instances in which a short height section is incorporated in the spooled garment, as illustrated in FIG. 5, a strong stitch or seam 31 should be formed from one end to the other along the length of the garment.

As those skilled in the art appreciate, while the spooled garment contains three sections in this embodiment, one may chose to use less sections or include additional sections, whatever the manufacturer's preference may be.

The complementary fabric fastener 22, which fastens to the fabric fastener on the doll's torso, is attached to the front end of the first section, suitably sewn in place or glued. Additional fabric fasteners 36 and 38 are in like manner attached to the other end of that garment for connection to complementary fabric fasteners, not illustrated, attached to the cylindrical wall of cylinder 9.

While all sections are approximately equal in length and sized to fit about the doll's torso, for increased realism, succeeding sections are slightly larger than former sections to account for the slight additional distance about the periphery of the doll brought about by the prior layers of material. The length of the first section is approximately equal to the distance around the periphery of the doll; the next section is of a length approximately equal to the distance around the periphery of the doll with the first section wrapped around the doll, which increases the distance slightly due to the thickness of the material; and the third section is slightly larger in length still so that it may cover the doll and the two preceding layers of material wrapped around the doll.

In preparation by the manufacturer, an end of the wrap around garment is attached to cylinder 9, suitably by a fabric fasteners 36 and 38 that attaches to the complementary fabric fastener, not illustrated, on the cylinder wall, and the garment is wound about or spooled upon the cylinder, with the underwear section 30 being the last wound therein so that such section may be unspooled first. This leaves the forward end of the swatch free for connection to the doll.

While only one such spool of clothing is included in the embodiment of FIG. 1, it is recognized that the play doll combination may incorporate additional spools of clothing to simulate additional articles of clothing.

It is recalled that the doll simulates a human female, adding an element of realism to the child's play. Preferably the color of the plastic material which forms the doll torso and the color of the fabric fastener are the same, whereby the fastener is completely camouflaged and appears as a simulation of the "backbone" or spine of the doll. Considered apart from the other elements of the combination, so constructed the doll thus simulates a human with a backbone that doubles as a fastener.

Returning to FIG. 1, in use a small child or a supervising adult installs the spool of clothing upon the shaft and slips the doll onto the pins so that the doll stands upright on the turntable. The end of the garment is connected by means of the fabric fastener to the doll's back side. The child may then turn the hand crank 13 and rotate the turntable. As the turntable rotates the cloth swatch dispenses from the cylinder, which, due to the driving gear and driven gear relationship of gear teeth 21 and 23, rotates in synchronism therewith, and wraps the first section of garment onto the doll's torso. The child continues cranking until the first section of the garment is wrapped about the doll.

The child may then decide to repeat the operation and spool the next section of dress onto the doll in overlying relationship with the preceding section of clothing. The child may repeat this process until it has changed the doll's dress as many times as there are different sections on the swatch.

To undress the doll the child simply rotates the turntable in the opposite rotational direction. Since the cylinder rotates in synchronism the garment is unwound from the doll and rewound onto the cylinder. Were a different construction used in which the turntable and cylinder were not so synchronized, then the child would have to rotate the cylinder instead and pull the material from the doll, while the turntable free wheels under such alternative construction.

In this embodiment, the turntable is rotated by hand turning the crank 13. In other embodiments, the hand crank and gear may be removed from the combination. The doll may be rotated then by placing a finger on the edge of the turntable and pulling the finger toward the child to rotate the turntable.

Preferably, when the entire length is unspooled, the child may unfasten and detach the fasteners 36 and 38, illustrated in FIG. 5, from cylinder 9, and wrap the end of the garment around the doll, fastening that free end to complementary fabric fasteners 36' and 38' not illustrated, located on the opposite side of the material, so that the last dress remains in place on the doll. The doll may then be removed from the turntable and the child can insert another doll and another spool of clothing onto the base 16.

Moreover, instead of forming the gears integral with the turntable and with the spool, other gears may be mounted on the underside of the base, connected to the respective turntable and spool by shafts extending through the top of the base. And while hand cranking or turning has been used, one can instead employ a battery operated motor to drive the gears, in which case the child need only hold down a switch to rotate the doll. Many alternative embodiments are possible and come within the invention.

It is believed that the foregoing description of the preferred embodiment of the invention is sufficient in detail to enable one skilled in the art to make and use the invention. However, it is expressly understood that the details of the elements which are presented for the foregoing enabling purpose are not intended to limit the scope of the invention, in as much as equivalents to those elements and other modifications thereof, all of which come within the scope of the invention, become apparent to those skilled in the art upon reading this specification. Thus the invention is to be broadly construed within the full scope of the appended claims.

What is claimed is:

1. The invention which comprises in combination:

a doll having a torso of predetermined height, first spool means, said spool means being mounted for rotation about an axis;

a length of garment material wound about said spool, said material containing at least one section along the length thereof that simulates a garment responsive to being wrapped about a doll torso;

turntable means, having an axis of rotation;

doll mounting means for fixedly coupling said doll in upstanding position on said turntable means for essentially co-axial rotation therewith;

fastener means for attaching an end of said spooled garment material to said doll torso; whereby rotation of said turntable means unspools at least a portion of said spooled material from said spool and winds at least a portion of said material about said doll torso.

2. The invention as defined in claim 1 wherein said length of said garment material comprises a plurality of different sections connected in series, said sections being visually distinguishable from one another, so as to provide different garment simulations.

3. The invention as defined in claim 2 wherein each said section is of a length approximately equal to the circumference of said doll torso, wherein a different garment is simulated upon said doll to thereby change the dress of said doll responsive to each revolution of said turntable.

4. The invention as defined in claim 1, wherein said doll torso further comprises:

a backside;

a narrow vertically extending recess within said backside of said torso, located essentially centrally of said backside and extending between the upper and lower back portions;

and wherein said fastening means comprises:

an elongate narrow strip of fabric fastener material, said fabric type fastener material having a backside attachment surface and a hook side connecting surface and being essentially of the same length as said recess in said torso; said backside attachment surface being fitted in said recess to mount said fabric fastener material to said torso, with the fastening hook portion thereon facing outwardly for releasible connecting engagement to a complementary fastener element attached to a garment material; and wherein said fastening means includes a complementary fabric fastener, said complementary fastener being connected to an end of said garment material.

5. The invention as defined in claim 1 wherein said fastening means comprises a hook and loop type fabric fastener.

6. The invention as defined in claim 1, wherein said doll is formed of plastic material.

7. The invention as defined in claim 1, further comprising in combination: hand crank means for rotating said turntable means.

8. The invention as defined in claim 1, wherein said doll comprises plastic; and wherein said length of said garment material comprises: a plurality of different sections connected in series, said sections being visually distinguishable from one another, so as to provide different garment simulations;

each said section being of a length approximately equal to the circumference of said doll torso, wherein a different garment is simulated upon said doll to thereby change the dress of said doll responsive to each revolution of said turntable;

and wherein said doll torso further comprises:

a backside of a predetermined color;

a narrow vertically extending recess within said backside of said torso, located essentially centrally of said backside and extending between the upper and lower back portions;

and wherein said fastening means comprises:

an elongate narrow strip of fabric fastener material, said fabric type fastener material having a backside attachment surface and a hook side connecting surface and being essentially of the same color as said torso and of the same length as said recess in said torso;

said backside attachment surface being fitted in said recess to mount said fabric fastener material to said torso, with the fastening hook portion thereon facing outwardly for releasible connecting engagement to a complementary fastener element attached to a garment material; and wherein said fastening means includes a complementary fabric fastener, said complementary fastener being connected to an end of said garment material.

9. The invention as defined in claim 8 wherein said fastening means comprises a hook and loop type fabric fastener.

10. The method of changing the dress of a doll from a first dress to a second dress, said second dress being visually distinguishable from said first dress, which includes the steps of: rotating a doll dressed in a first dress through an angle of 360 degrees to unspool a length of material representing a second dress from a spooled roll and wrap the unspooled material about the torso of said doll in overlying relationship of said first dress, said unspooled material being visually distinguishable in appearance from said first dress.

11. A multi-dress garment for a fashion doll capable of simulating a variety of decorative appearances comprising:

a continuous band of clothing material of predetermined length, said band being divided into a plurality of sections in serial order, with such sections being visually distinct from one another; each said section being of a length approximately equal to the peripheral distance about the outer surface of said doll torso but progressively slightly greater in length, whereby each section may be wrapped in turn about the torso of the doll to simulate a different dress with subsequent sections wrapped in overlying relationship to any prior sections.

12. The invention as defined in claim 11 at least one end of said band includes a hook and loop type fabric fastener.

13. The invention comprising:

a doll configured to simulate a human figure, including a head, torso, legs and arms connected to said torso, said arms being articulated to permit raising and lowering of said arms and with said torso containing a front chest side and a rear back side;

a wrap-around garment to clothe said torso, said wrap-around garment being free of surface openings capable of receiving any of said legs and arms;

means for coupling said legs to a rotatable base;

wherein said rear back side of said torso includes a simulated spine bone; and wherein said simulated spine bone comprises: fastener means for fastening an end of said wrap-around garment to said torso.

14. The invention as defined in claim 13, wherein said rear back side of said torso further includes a narrow elongate vertically extending recess for receiving said simulated spine bone; and wherein said fastener means further comprises:

an elongate narrow strip of fabric fastener material, said fabric fastener material having a backside attachment surface and an opposed hook front side fastening surface;

said backside attachment surface being fitted in said recess to mount said fabric fastener material to said torso, with the fastening hook portion thereon facing outwardly for releasible connecting engagement to a complementary fastener material attached to an end of said wrap around garment.

15. The invention as defined in claim 14, wherein said fabric fastener material comprises: hook and loop type fastener material.

16. The invention as defined in claim 14, wherein said doll torso comprises a predetermined color and wherein said fabric fastener material comprises essentially said same predetermined color.

17. The invention comprising:

a doll configured to simulate a human figure, including a head, torso, legs and arms connected to said torso, with said torso containing a front chest side and a rear back side;

wrap-around garment to clothe said torso, fastener means for fastening an end of said wrap-around garment material to said torso, said fastener means being located at said rear back side of said torso and said fastener means defining a spine in said rear back side;

spool means mounted for rotation about an axis; and wherein a portion of said garment material is spirally formed about and is supported by said spool means for dispensing therefrom.

18. The invention as defined in claim 17, wherein said wrap around garment material further comprises: a plurality of sections arranged in serial order, with such sections being visibly distinct from one another; each said section being of a length approximately equal to the peripheral distance about the outer surface of said doll torso, but progressively slightly greater in length, whereby each section of said garment material may be wrapped about the torso of the doll in overlying relationship to a previous section to simulate a change of dress.

19. The invention as defined in claim 18 further comprising: means for holding said doll in upright position and rotating said doll coaxially with rotation of said spool means.

20. The invention as defined in claim 18 further comprising spool fastener means for connecting an end of said garment material to said spool means, said spool fastener means comprising a hook and loop type fabric fastener.

* * * * *